US009868153B2

(12) United States Patent
Suzuki

(10) Patent No.: US 9,868,153 B2
(45) Date of Patent: Jan. 16, 2018

(54) MIXED POWDER FOR POWDER METALLURGY AND MANUFACTURING METHOD THEREOF

(71) Applicant: Kobe Steel, Ltd., Kobe-shi (JP)

(72) Inventor: Hironori Suzuki, Takasago-shi (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/615,912

(22) Filed: Feb. 6, 2015

(65) Prior Publication Data

US 2015/0151361 A1 Jun. 4, 2015

Related U.S. Application Data

(62) Division of application No. 13/822,444, filed as application No. PCT/JP2011/074418 on Oct. 24, 2011.

(30) Foreign Application Priority Data

Nov. 9, 2010 (JP) ..... 2010-250867

(51) Int. Cl.
*B22F 1/00* (2006.01)
*C22C 26/00* (2006.01)

(52) U.S. Cl.
CPC ..... *B22F 1/0081* (2013.01); *B22F 1/007* (2013.01); *B22F 1/0059* (2013.01); *B22F 2999/00* (2013.01); *C22C 2026/001* (2013.01)

(58) Field of Classification Search
CPC ..... B22F 1/0059; B22F 2302/40
(Continued)

(56) References Cited

U.S. PATENT DOCUMENTS 4,676,831 A 6/1987 Engstrom
5,132,338 A * 7/1992 Hayami et al. ..... 523/139
(Continued)

FOREIGN PATENT DOCUMENTS

JP 52 56060 5/1977
JP 54 90007 7/1979
(Continued)

OTHER PUBLICATIONS

International Search Report dated Jan. 24, 2012 in PCT/JP11/074418 Filed Oct. 24, 2011.
(Continued)

*Primary Examiner* — Kaj K Olsen
*Assistant Examiner* — Alexander Polyansky
(74) *Attorney, Agent, or Firm* — Oblon, McClelland, Maier & Neustadt, L.L.P.

(57) ABSTRACT

This mixed powder for powder metallurgy, the powder having excellent fluidity and minimal graphite powder scattering, can be obtained relatively conveniently by mixing fine graphite having an average grain diameter of 4 μm or less with an iron based powder. The process is performed without the addition of a binder and while shearing force is applied. It is preferable that the fine graphite have an average grain diameter of 2.4 μm or less and be wet-milled. A portion of the fine graphite is preferably added in place of at least one constituent selected from the group consisting of carbon black, fullerene, carbon compounds carbonized by baking, and graphite having an average grain diameter of 5 μm or more.

19 Claims, 1 Drawing Sheet

(58) Field of Classification Search
USPC ..... 75/252
See application file for complete search history.

(56) References Cited

U.S. PATENT DOCUMENTS

| | | | | |
|---|---|---|---|---|
| 5,286,275 | A | 2/1994 | Murakami et al. | |
| 5,525,293 | A * | 6/1996 | Kagawa et al. | 419/65 |
| 2009/0007725 | A1 * | 1/2009 | Fujiura | B22F 1/0059 75/243 |
| 2009/0165595 | A1 * | 7/2009 | Yamamoto | C22C 1/0433 75/243 |

FOREIGN PATENT DOCUMENTS

| | | |
|---|---|---|
| JP | 60 502158 | 12/1985 |
| JP | 1 219101 | 9/1989 |
| JP | 5 86403 | 4/1993 |
| JP | 6 49503 | 2/1994 |
| JP | 7 173503 | 7/1995 |
| JP | 2635752 B2 * | 7/1997 |
| JP | 2005 330547 | 12/2005 |
| JP | 2007 31744 | 2/2007 |
| JP | 2008050245 A * | 3/2008 |
| JP | 2009 263697 | 11/2009 |
| WO | WO 01/17716 A1 | 3/2001 |

OTHER PUBLICATIONS

Angelo R. Subramanian, "Science, Technology and Applications" Powder Metallurgy, 2008, 5 Pages.
"Teknisk Tidskrift" (Technical Journal), Kemi, http://runeberg.org/tektid/1943k0077.html, 1943, 4 Pages (with English translation).
"International Standard ISO 13320-1, Particle size analysis—Laser diffraction methods, Part 1: General Principles" First edition, 1999, pp. ii-v and 1-34.
https://www.seair.co.in/Auto-import-data/hs-code-25049090/country-japan.aspx; Excerpt cited in Reply filed by Opponent on Mar. 28, 2017 in Swedish Patent No. 1350550-8.
Document T674/96 (22 pages); cited in Reply filed by Opponent on Mar. 28, 2017 in Swedish Patent No. 1350550-8.

* cited by examiner

MIXED POWDER FOR POWDER METALLURGY AND MANUFACTURING METHOD THEREOF

CROSS REFERENCE TO RELATED APPLICATION

This application is a divisional of U.S. application Ser. No.13/822,444, filed Mar. 12, 2013, which is a 371 of PCT/JP2011/074418, filed on Oct. 24, 2011, and claims priority to Japanese Patent Application No. 2010-250867, filed on Nov. 9, 2010.

TECHNICAL FIELD

The present invention relates to a powder metallurgy technology of forming and sintering an iron based powder, and manufacturing a sintered body. More particularly, it relates to a mixed powder for powder metallurgy, which causes less scattering of a graphite powder, and is excellent in flowability, and a manufacturing method thereof.

BACKGROUND ART

In powder metallurgy by which a sintered body is manufactured using an iron powder or a copper powder as a main raw material, generally, there is used a mixed powder including a powder of the main raw material, a sub raw material powder (such as a graphite powder or an alloy component) for improving the physical properties of the sintered body, a lubricant, and the like. Particularly, in order to improve the mechanical physical properties (such as strength and hardness) of the sintered body, generally, carbon supplying component (carbon source) such as graphite is added, and the mixture is formed, followed by diffusion and carburization of the carbon source into the iron powder during a heat sintering treatment.

However, a graphite is smaller in specific gravity and smaller in particle diameter than an iron powder. For these reasons, mere mixing thereof results in that the graphite and the iron powder are largely separated from each other, and that the graphite segregates. Thus, uniform mixing thereof unfavorably cannot be achieved. With the powder metallurgy method, sintered bodies are mass-produced. For this reason, generally, a mixed powder is previously stored in a storage hopper. In the storage hopper, a graphite having a small specific gravity tends to segregate at the upper layer part of the hopper. Accordingly, when the mixed powder is discharged from the hopper, the concentration of the graphite increases in the end of hopper discharge. Thus, in the portion having a high graphite concentration in the sintered body, a cementite structure precipitates, resulting in the reduction of the mechanical characteristics. When a variation is caused in the content of carbon in the sintered body due to the segregation of graphite, it becomes difficult to manufacture components with stable qualities. Further, in the mixing step or the forming step, the segregation of graphite causes dust emission of the graphite powder. This unfavorably results in the problems of the aggravation of the workplace environment and the reduction of the handling property of the mixed powder. The foregoing segregation also similarly occurs not only for graphite but also for other various powders to be mixed with the iron powder. This has created a demand for prevention of the segregation.

In order to prevent the segregation and the dust emission of graphite, broadly classified three methods have been proposed in the related art. The first method is a method for adding a liquid additive such as tall oil to a mixed powder (e.g., Patent Documents 1 and 2). This method has an advantage of enabling manufacturing with simple facilities. However, when a liquid additive is added in an amount necessary for the segregation preventive effect to be observed, a liquid cross-linking force acts on among iron powder particles. This unfavorably results in extreme aggravation of flowability. The second method is a method in which a solid binder such as a high molecule polymer is dissolved in a solvent, and is uniformly mixed therein, followed by the evaporation of the solvent, thereby to allow graphite to adhere to the surface of an iron powder (Patent Documents 3, 4, and the like). This method has advantages of being capable of surely allowing graphite to adhere thereto, and also having a wide choice of options for lubricants to be used. However, the flowability of the mixed powder may be insufficient according to the composition. The third method is a so-called hot melt method characterized by heating and melting a relatively lower molecular weight lubricant such as fatty acid during mixing with an iron powder (e.g., Patent Document 5). The molten lubricant is uniformly fixed on the iron powder surface. For this reason, the temperature control during mixing is very important. Further, there is also a deficiency that the options for usable lubricants are restricted. With any of the first to third methods, an organic binder is added, which must result in a complicated step. This has created a demand for a more simple method.

Incidentally, although irrelevant to the segregation prevention, there is also proposed a technology of controlling the particle size of graphite. In Patent Document 6, a 0.1- to 2-μm graphite and an iron powder are mixed in a vibration mill with adding additives in a specific atmosphere such as ammonia. Thus, the iron powder particle surface is covered with graphite particles. In Patent Documents 7 and 8, the particle size of graphite is controlled, and using an organic binder, the iron powder surface is covered with graphite.

PATENT DOCUMENTS

[Patent Document 1] JP-A No. 60-502158
[Patent Document 2] JP-A No. 6-49503
[Patent Document 3] JP-A No. 5-86403
[Patent Document 4] JP-A No. 7-173503
[Patent Document 5] JP-A No. 1-219101
[Patent Document 6] JP-A No. 54-90007
[Patent Document 7] JP-A No. 2005-330547
[Patent Document 8] JP-A No. 2009-263697

DISCLOSURE OF THE INVENTION

It is an object of the present invention to relatively easily provide a mixed powder for powder metallurgy which causes less scattering of a graphite powder, and is excellent in flowability, and a manufacturing method thereof.

The mixed powder for powder metallurgy of the present invention which achieved the foregoing object is characterized by being obtained by mixing a fine graphite with a mean particle size of 4 μm or less with an iron based powder without adding a binder and while applying a shear force. It is preferable that the fine graphite has a mean particle size of 2.4 μm or less, and has been subjected to wet crushing.

For the mixed powder for powder metallurgy of the present invention, it is also preferable that the fine graphite has been partially replaced with at least one selected from the group consisting of carbon black, fullerene, a carbon compound to be carbonized by burning, and a graphite with a mean particle size of 5 μm or more, to be added. In this case, it is preferable that the total amount of all the graphites, carbon black, fullerene, and the carbon compound to be carbonized by burning is 0.1 part by mass or more and 3 parts by mass or less per 100 parts by mass of the iron based powder. Further, the mixed powder for powder metallurgy of the present invention preferably includes at least one selected from the group consisting of a lubricant, a strength improver, an abrasion resistance improver, and a machinability improver. Alternatively, for mixing of the graphite and the iron based powder, a small amount of binder may be added. The mixed powder for powder metallurgy obtained by mixing a fine graphite with a mean particle size of 4 μm or less with an iron based powder with adding a binder in a ratio of 0.1 part by mass or less per 100 parts by mass of the iron based powder and while applying a shear force is also embraced in the present invention.

In accordance with the present invention, the mean particle size of graphite is refined, and mixing with an iron based powder is performed while applying a shear force. For these reasons, it is possible to obtain a mixed powder for powder metallurgy excellent in adhesive force between the graphite and the iron based powder even without adding a binder. As a result, it is possible to suppress the segregation of graphite. Further, the mixed powder for powder metallurgy of the present invention is also excellent in flowability. The mixed powder for powder metallurgy of the present invention does not require the addition of a binder, and hence can be manufactured at a low cost, and also has an advantage of high productivity.

DISCLOSURE OF THE INVENTION

Figure 1:
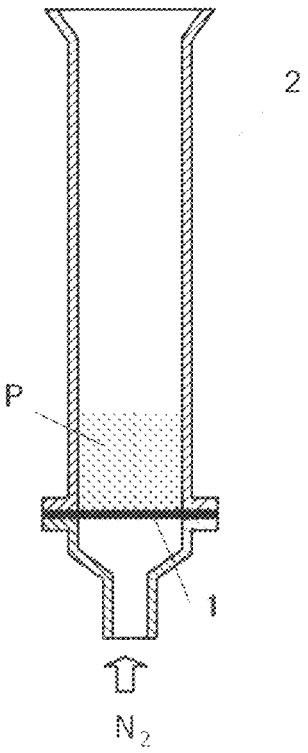
FIG. 1 is a cross-sectional view of an apparatus for use in measurement of the scattering ratio of graphite in examples.

A mixed powder for powder metallurgy of the present invention is characterized by being obtained by mixing a fine graphite with an iron based powder while applying a shear force.

For the fine graphite in the present invention, the mean particle size according to the measuring method by the Microtrac method is 4 μm or less. The mechanism in which graphite is refined to the foregoing range, thereby to increase the adhesive force with an iron powder is not fully elucidated. However, a decrease in particle size of graphite results in an increase in specific surface area. Thus, adhesion by a physical force such as static electricity is conceivable. Further, it is conceivable that a chemical force also acts. Namely, it is considered that the crushed surface of the finely crushed graphite includes large quantities of functional groups such as a hydrogen group. Thus, presumably, an intermolecular force occurs between the iron powder and graphite via the functional groups, so that graphite adheres onto the iron powder surface. The presence or absence of the functional groups and the contents thereof can be grasped to a certain degree by heating graphite in a nitrogen atmosphere, and measuring the mass change ratio at from room temperature to 950° C. The temperature rising rate for raising the temperature from room temperature up to 950° C. is desirably set at about 10° C./min. Generally, the kind of a gas generated from graphite varies from one heating temperature region to another. The kind of the functional group removed within the temperature range can be estimated from the kind of the generated gas. As generally known, at 150 to 500° C., a carboxyl group (—COOH) and a hydroxy group (—OH) are removed; at 500 to 900° C., an oxo group (=O) is removed; and at 900° C. or more, a hydrogen group (—H) is removed. By checking the weight loss amount at 150 to 950° C., it is possible to remove the effect of the decrease in weight of the moisture removable at a lower temperature than 150° C. Accordingly, it is possible to know the kind and the content of each functional group included in graphite.

The mean particle size of the fine graphite is preferably 2.4 μm or less, more preferably 2.2 μm or less, and further preferably 2.0 μm or less. Although the lower limit of the mean particle size of the fine graphite has no particular restriction, it is generally about 1.0 μm. In order to set the mean particle size of the fine graphite within the foregoing range, a commercially available natural graphite or an artificial graphite may desirably be crushed using a crusher. The atmosphere for crushing has no particular restriction. Crushing may be performed by a dry process, or crushing may be performed by a wet process. However, wet crushing is preferable. When wet crushing is performed, water, alcohol, or the like can be used as a solvent. As a crusher, a general crusher can be used. Examples thereof are roll crusher, cutter mill, rotary crusher, hammer crusher, vibration mill, pin mill, wing mill, ball mill, and planetary mill.

It is important that the fine graphite and the iron based powder in the present invention are mixed while being applied with a shear force. The mixing method whereby a shear force is applied is a different method from a convection mixing method as represented by a V type mixer or a double corn mixer. Mixing while applying a shear force enables mixing while minimizing the distance between the iron powder and the fine graphite. As a result, it is possible to effectively exhibit the adhesive force improving effect due to the refinement of graphite.

Mixing providing a shear force can be achieved by using, for example, a mixer equipped with stirring vanes moving in such a manner as to cut the powder. As the shapes of the stirring vanes, mention may be made of paddle, turbine, ribbon, screw, multi-stage vane, anchor type, horseshoe type, gate type, and the like. As long as the mixer includes the stirring vanes, the container of the mixer may be of a fixed type, or may be of a rotary type. As the mixers equipped with the stirring vanes, specifically, mention may be made of high speed mixers (manufactured by Henschel Co., and the like), plow type mixers, nauta mixers, and the like. Although the mixing time depends upon the type of the mixer to be used, the amount of mixed powders, and the like, it is roughly 1 to 20 minutes.

Mixing of the fine graphite and the iron based powder may be performed by a wet process, or may be performed by a dry process. Further, the mixing procedure of the fine graphite and the iron based powder has no particular restriction. In other words, the powders may be charged into a mixer at the same time. Alternatively, it is also acceptable that one powder is charged into the mixer first, and the other powder is added later.

Mixing of the fine graphite and the iron based powder is not performed by being heated to a temperature enough for a lubricant and the like to be molten, or higher as with the so-called hot melt method, but may be performed, for example, at ordinary temperatures. Further, although the atmosphere for mixing has no particular restriction, it may be the air.

In the present invention, as the carbon source, only the fine graphite may be used. Alternatively, for the purpose of reducing the manufacturing cost, the fine graphite may be partially replaced with one or more of general graphite (generally, having a mean particle size of 5 μm or more), carbon black, fullerene, and a carbon compound which is carbonized by burning, to be used. The powders may be desirably added during the mixing of the fine graphite and the iron based powder. The adding order has no particular restriction. However, for example, the fine graphite, the iron based powder, and other carbon sources than the fine graphite may be simultaneously added to a mixer and mixed. Alternatively, the following may be adopted: the fine graphite and the iron based powder are mixed first; and then, while mixing them (for example, while operating stirring vanes), other carbon sources than the fine graphite are added one by one, or in combination of two or more thereof. In this case, the ratio of the fine graphite is preferably 15 mass % or more, more preferably 20 mass % or more, and further preferably 25 mass % or more based on the total mass of the carbon sources (i.e., all the graphites (the fine graphite and common graphite), and one or more of carbon black, fullerene, and the carbon compound to be carbonized by burning). The carbon compound to be carbonized by burning may be derived from a plant or may be derived from an animal, and is, for example, active carbon, charcoal, or anthracite.

The content of the carbon sources is generally 0.1 part by mass or more and 3 parts by mass or less per 100 parts by mass of the iron based powder. The lower limit of the content of the carbon sources is preferably 0.2 part by mass or more, and more preferably 0.3 part by mass or more per 100 parts by mass of the iron based powder. Whereas, the upper limit of the content of the carbon sources is preferably 2.5 parts by mass or less, and more preferably 2.0 parts by mass or less (particularly, 1.3 parts by mass or less) per 100 parts by mass of the iron based powder.

The mixed powder for powder metallurgy of the present invention may further include at least one selected from the group consisting of a lubricant, and physical property improving additives (e.g., a strength improver, an abrasion resistance improver, and a machinability improver). The powders may be added when the fine graphite and the iron based powder are mixed. The adding order has no particular restriction. For example, the fine graphite and the iron based powder may be simultaneously added to a mixer and mixed. Alternatively, the following may be adopted: the fine graphite and the iron based powder are mixed first; and then, while mixing them (for example, while operating the stirring vanes), the lubricant and the physical property improving additives are added one by one, or in combination of two or more thereof to the mixer.

As the lubricants, mention may be made of metallic soap, alkylenebis fatty acid amide, fatty acid, and the like. These may be used alone, or may be used in combination of two or more thereof. The metallic soap includes therein fatty acid salts, for example, fatty acid salts having 12 or more carbon atoms. Zinc stearate is preferably used. As the fatty acid of the alkylenebis fatty acid amide, for example, a compound exemplified as $R_1$ COOH can be used. As the alkylenebis fatty acid amide, specifically, mention may be made of $C_{2-6}$ alkylenebis $C_{12-24}$ carboxylic acid amide. Ethylenebis stearylamide is preferably used. As the fatty acids, for example, a compound exemplified as $R_1$COOH can be used, and is preferably carboxylic acid having about 16 to 22 carbon atoms. Particularly, stearic acid and oleic acid are preferably used. The content of the lubricant is, for example, 0.3 part by mass or more and 1.5 parts by mass or less, and more preferably 0.5 part by mass or more and 1.0 part by mass or less per 100 parts by mass of the iron based powder.

As the strength improvers, mention may be made of, for example, powders including at least one of copper, nickel, chromium, molybdenum, manganese, and silicon. Specifically, they are a copper powder, a nickel powder, a chromium-containing powder, a molybdenum powder, a manganese-containing powder, a silicon-containing powder, and the like. The strength improvers may be used alone, or may be used in combination of two or more thereof. The amount of the strength improver to be added is, for example, 0.2 part by mass or more and 5 parts by mass or less, and more preferably 0.3 part by mass or more and 3 parts by mass or less per 100 parts by mass of the iron based powder.

As the abrasion resistance improvers, mention may be made of hard particles of carbide, silicide, nitride, and the like. These may be used alone, or may be used in combination of two or more thereof.

As the machinability improvers, mention may be made of manganese sulfide, talc, calcium fluoride, and the like. These may be used alone, or may be used in combination of two or more thereof.

The mixed powder for powder metallurgy of the present invention is excellent in adhesive force between graphite and an iron based powder even when a binder is added thereto. However, the present invention also embraces a mode in which a binder is added within the range of 0.1 part by mass or less per 100 parts by mass of the iron based powder. The binder amount is more preferably 0.08 part by mass or less, and further preferably 0.05 part by mass or less.

The iron based powder for use in the present invention may be any of a pure iron powder and an iron alloy powder. The iron alloy powder may be a partial alloy powder in which an alloy powder (e.g., copper, nickel, chromium, or molybdenum) is diffused and adheres to the surface of an iron based powder, or may be a prealloy powder obtained from molten iron (or molten steel) including alloy components (the same components as those of the alloy powder). The iron based powder is generally manufactured by subjecting molten iron or steel to an atomizing treatment. Alternatively, the iron based powder may be a reduced iron powder manufactured by reducing an iron ore or a mill scale. The mean particle size of the iron based powder is, for example, 30 to 150 μm, and preferably 50 to 100 μm. The mean particle size of the iron based powder means the particle size at a cumulative undersize amount of 50% when the particle size distribution is measured according to Japan Powder Metallurgy Association standard JPMA P 02-1992 (testing method for sieve analysis of metal powder).

For the mixed powder for powder metallurgy of the present invention, as described above, the particle size of graphite is controlled, and as a mixing method thereof, a proper one is adopted. For these reasons, the adhesive force between the graphite and the iron based powder can be enhanced without adding a binder (such as an organic bonding agent). As a result, it is possible to suppress the segregation of graphite. Thus, the graphite scattering ratio obtainable by a method described later can be set at, for example, 20% or less, and can be set at preferably 15% or less, and more preferably 10% or less. Further, in the mixed powder of the present invention, a binder is not added. Alternatively, even when a binder is added, it is added in a small amount (0.1 part by mass or less). For this reason, as compared with the one including a binder added therein, the density of a formed body when the formed body is formed under the same forming pressure, and the density of a sintered body obtained by sintering the formed body become higher, resulting in an enhancement of the strength of the sintered body. Further, for the mixed powder of the present invention, it is possible to omit or simplify the dewaxing step to be performed between the forming step and the sintering step. This contributes to the improvement of the productivity of sintered components and also the environmental measures.

Further, it is possible to implement the stabilization of the quality such as minimization of the dimensional changes by the refinement of graphite. Thus, it is also possible to implement energy saving and cost reduction in manufacturing of sintered components such as reduction of the sintering temperature or the shortening of the sintering time. The mixed powder of the present invention is applicable to sintered components for mechanical structures, and the like. Particularly, it is also applicable to components in the complicated and thin-walled shapes. Then, weight reduction can be achieved, and hence the mixed powder of the present invention is also suitable for high strength materials.

EXAMPLES

Below, the present invention will be described more specifically by way of examples. The present invention is not limited by the following examples. It is naturally understood that the present invention can be practiced by adding appropriate changes thereto within the scope applicable to the gist described above and later. Any of these are included in the technical range of the present invention.

For each example, the scattering ratio of graphite, the apparent density and the flowability of the mixed powder were measured by the following methods.

(1) Scattering Ratio of Graphite

As shown in FIG. 1, in a glass tube 2 (inner diameter: 16 mm, height 106 mm) with a funnel shape at its lower part, a nuclepore filter 1 (mesh 12 μm) was set. Thereon, 25 g of a mixed powder P was charged. From the lower part of the glass tube 2, a $N_2$ gas was passed at a rate of 0.8 l/min for 20 minutes. Thus, the graphite scattering ratio was determined by the following equation (1). In other words, graphite not adhering to the iron powder scatters by the $N_2$ gas circulated from under. For this reason, it is possible to determine the graphite scattering ratio by the following equation (1). Incidentally, the amounts of carbon of the mixed powder before and after $N_2$ gas circulation can be measured by the combustion method.

$$\text{Graphite scattering ratio}(\%)=(1-\text{Carbon amount after } N^2 \text{ gas circulation}/\text{Carbon amount before } N_2 \text{ gas circulation})\times 100 \quad (1)$$

(2) Apparent Density of Mixed Powder

According to JIS Z2504 (metal powder—apparent density testing method), the apparent density (g/cm3) of the mixed powder was measured.

(3) Flowability of Mixed Powder

According to JIS Z2502 (flowability testing method of metal powder), the flowability of (sec/50 g) of the mixed powder was measured. Namely, the time (sec) until 50 g of the mixed powder flowed out through an orifice with a diameter of 2.63 mm was measured. The time (sec) is referred to as the flowability of the mixed powder.

Example 1

Figure 2:
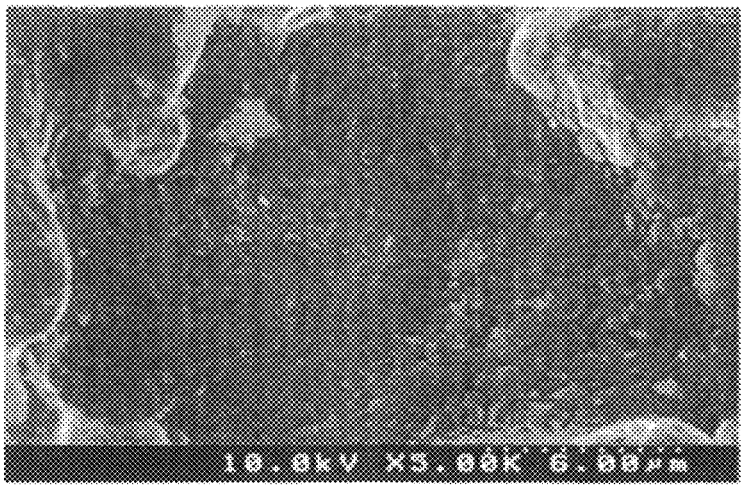
FIG. 2 is a SEM photograph when the surface of a mixed powder in an example is observed by a SEM (scanning electron microscope).

A commercially available natural graphite (manufactured by Nippon Graphite Ltd., JCPB, mean particle size 5.0 μm) was subjected to wet type bead mill crushing (solvent: water), then, was dried, and further was crushed by a dry type jet mill, resulting in a graphite with a mean particle size of 2.1 μm (the particle size of graphite was measured by a Microtrac 9300-X100). Per 100 parts by mass of an iron powder (manufactured by KOBE STEEL Ltd., Atmel 300M, particle side 180 μm or less, mean particle size 70 μm), 0.8 part by mass of the graphite was simultaneously charged into a high speed mixer without adding a binder or a lubricant, and without applying a heat thereto, and the mixture was mixed for 5 minutes, resulting in a mixed powder. The graphite scattering ratio of the resulting mixed powder was 1%. Further, the results obtained from observation under a SEM are shown in FIG. 2. FIG. 2 indicates that the fine graphite uniformly adheres to the surface of the iron powder.

On the other hand, for comparison, a mixed powder was obtained in the same manner as described above, except that the JCPB was used as it was without being crushed. As a result, the graphite scattering ratio was bout 50%. Further, the mixed powder was observed under a SEM. As a result, it was found that graphite only partially entered and adhered to the pits of the iron powder, and that most of the graphite did not adhere thereto.

Example 2

Graphite powders obtained by adjusting a commercially available natural graphite (manufactured by Japan Graphite Co., Ltd., JCPB, mean particle size 5.0 μm) various particle sizes according to the methods described in Table 1 (wherein JCPB itself was used for Nos. 1 and 2 of Table 1), an iron powder (manufactured by KOBE STEEL Ltd., Atmel 300M, particle side 180 μm or less, mean particle size 70 μm), and a copper powder (manufactured by FUKUDA METAL FOIL & POWDER Co., Ltd., CE-20) were simultaneously added to their respective mixers shown in Table 1 in a ratio of copper powder: 2 parts by mass and graphite: 0.8 part by mass per 100 parts by mass of the iron powder, and each mixture was mixed, resulting in each mixed powder for graphite scattering ratio measurement. The particle size of each graphite was measured by the Microtrac 9300-X100 as with Example 1. Further, per 100 parts by mass of the mixed powder, 0.8 part by mass of an ethylenebisamide lubricant was mixed using each mixer shown in Table 1, resulting in each powder for apparent density and flowability measurement. Incidentally, the solvent for wet crushing performed for Nos. 7 and 8 of Table 1 is ethanol.

TABLE 1

| Experiment No. | Mean particle size of graphite (μm) | Crushing method of graphite | Mixing method of graphite and the like and iron powder | Graphite scattering ratio (%) | Apparent density (g/cm$^3$) | Flowability (sec/50 g) |
|---|---|---|---|---|---|---|
| 1 | 5.0 | — | Convection mixing (V type mixer) | 65 | 3.08 | No flowing |

TABLE 1-continued

| Experiment No. | Mean particle size of graphite (μm) | Crushing method of graphite | Mixing method of graphite and the like and iron powder | Graphite scattering ratio (%) | Apparent density (g/cm$^3$) | Flowability (sec/50 g) |
|---|---|---|---|---|---|---|
| 2 | 5.0 | — | Shear mixing (high speed mixer) | 55 | 3.10 | No flowing |
| 3 | 3.5 | Dry type jet mill | Convection mixing (V type mixer) | 42 | 3.12 | No flowing |
| 4 | 3.5 | Dry type jet mill | Shear mixing (high speed mixer) | 18 | 3.13 | 29.0 |
| 5 | 2.3 | Dry type mill + Dry type jet mill | Convection mixing (V type mixer) | 35 | 3.10 | No flowing |
| 6 | 2.3 | Dry type mill + Dry type jet mill | Shear mixing (high speed mixer) | 6 | 3.15 | 24.2 |
| 7 | 1.9 | Wet type crushing by Star Burst manufactured by Sugino Machine Ltd. | Convection mixing (V type mixer) | 28 | 3.20 | 27.0 |
| 8 | 1.9 | Wet type crushing by Star Burst manufactured by Sugino Machine Ltd. | Shear mixing (high speed mixer) | 1 | 3.25 | 24.0 |

For Experiment Nos. 4, 6, and 8, the mean particle size of graphite was small, and the graphite and the iron based powder were mixed by the shear mixing method. Accordingly, the scattering ratio of graphite was small, and the flowability was also good. Particularly, for Experiment Nos. 6 and 8, the mean particle size of graphite was 2.4 μm or less, and both of the scattering ratio of graphite and the flowability of the mixed powder were better than those of No. 4.

On the other hand, for Experiment Nos. 1 and 2, the mean particle size of graphite was large; and for Experiment No. 1, the convection mixing method was adopted. Accordingly, in both cases, it resulted that the scattering ratio of graphite was large, and that the mixed powder did not flow. For Experiment Nos. 3 and 5, although the mean particle size of graphite was 4 μm or less, the convection mixing method was adopted. Accordingly, it resulted that the scattering ratio of graphite was large, and that the mixed powder did not flow. For Experiment No. 7, although the mean particle size of graphite was 2.4 μm or less, and was very fine, the convection mixing method was adopted. Accordingly, the scattering ratio of graphite was large.

Further, from Table 1, there can be known the effects of the mean particle size and the mixing method of graphite exerted on the apparent density of the mixed powder. For example, comparison between Experiment Nos. 1 and 3, or between Experiment Nos. 2 and 4 indicates that a smaller mean particle size results in a larger apparent density of the mixed powder. Further, respective comparisons between Experiment Nos. 1 and 2, between 3 and 4, between 5 and 6, and between 7 and 8 indicate that the shear mixing method provides a larger apparent density of the mixed powder than that with the convection mixing method.

Example 3

Per 100 parts by mass of an iron powder (manufactured by KOBE STEEL Ltd., Atmel 300M, particle size 180 μm or less, mean particle size 70 μm), (i) the fine graphite used in Experiment No. 6 of Example 2, A15 carbon black manufactured by Degussa, and a commercially available natural graphite (manufactured by Japan Graphite Co., Ltd., JCPB, mean particle size: 5.0 μm) and, (ii) 2 parts by mass of a copper powder were simultaneously added to a high speed mixer with vanes, and the mixture was stirred for five minutes, resulting in a powder for measuring the graphite scattering ratio. Incidentally, the mixing ratios of the fine graphite, the carbon black, and the commercially available natural graphite (the ratios per 100 parts by mass of the iron powder) are as shown in Table 2. Further, 0.8 part by mass of an ethylenebisamide lubricant was mixed per 100 parts by mass of a graphite scattering ratio measuring mixed powder (stirred using a high speed mixer with vanes for 2 minutes), resulting in a powder for apparent density and flowability measurement.

TABLE 2

| Experiment No. | Fine graphite amount (part by mass) | Carbon black amount (part by mass) | JCPB amount (part by mass) | Graphite scattering ratio (%) | Apparent density (g/cm$^3$) | Flowability (sec/50 g) |
|---|---|---|---|---|---|---|
| 9 | 0.8 | 0 | 0 | 1 | 3.25 | 24.0 |
| 10 | 0.4 | 0.4 | 0 | 2 | 3.11 | 26.8 |
| 11 | 0.2 | 0.6 | 0 | 0 | 3.08 | 27.4 |
| 12 | 0.6 | 0 | 0.2 | 17 | 3.12 | 28.9 |

Table 2 indicates that, even when the fine graphite is partially replaced with carbon black and/or commercially available graphite (JCPB), to be used, the graphite scattering ratio can be sufficiently suppressed.

Example 4

Using Experiment Nos. 1 and 8 (powders after addition of the ethylenebisamide lubricant) of Example 2, and, for comparison, a conventional mixed powder (the one using a binder), formed bodies were manufactured under a pressure of 686 MPa each so as to be in a ring shape with an outer diameter of 30 mm, an inner diameter of 10 mm, and a height of 10 mm. Thus, each formed body density was measured by a method described later. The formed body was sintered under an atmosphere of 95% nitrogen, and 5% hydrogen at 1120° C. for 30 minutes. The density, the dimensional change ratio, the radial crushing strength, and the hardness of the resulting sintered body were measured by the following methods.

Incidentally, the manufacturing procedure of the conventional mixed powder (the one using a binder) is as follows. First, using a high speed mixer with vanes, 0.8 part by mass of a commercially available natural graphite (manufactured by Japan Graphite Co., Ltd., JCPB, mean particle size 5.0 μm) and 2 parts by mass of a copper powder (manufactured by FUKUDA METAL FOIL & POWDER Co., Ltd., CE-20) were mixed per 100 parts by mass an iron powder (manufactured by KOBE STEEL Ltd., Atmel 300M, particle side 180 μm or less, mean particle size 70 μm). Subsequently, 0.2 part by mass of a 10% styrene butadiene copolymer solution (solvent was toluene) was charged into a mixer per a total amount of 100 parts by mass of the iron powder, the natural graphite, and the copper powder, and the mixture was mixed for two minutes. Then, vacuum heating was performed to evaporate the toluene, resulting in a mixed powder. Per 100 parts by mass of the mixed powder, 0.8 part by mass of an ethylenebisamide lubricant was mixed (with stirring using a high speed mixer with vanes for two minutes).

(4) Measurement of Formed Body Density and Sintered Body Density

The formed body density and the sintered body density were determined by measuring respective dimensions of the formed body and the sintered body, and determining respective volumes, and measuring respective masses, and dividing the masses by the volumes, respectively.

(5) Measurement of Dimensional Change Ratio

The dimensional change ratio (%) was determined by the following equation (2).

$$\text{Dimensional change ratio}=\{(\text{outer diameter of sintered body})-(\text{outer diameter of formed body})\}/(\text{outer diameter of formed body})\times 100 \quad (2)$$

(6) Measurement of Radial Crushing Strength

Radial crushing pressing is performed in the direction of the forming axis of the sintered body and the vertical direction thereof. Thus, the strength when the ring was broken was measured, and the radial crushing strength (MPa) was determined according to JIS Z2507.

(7) Measurement of Hardness

Given respective three points (a total of six points) on the front surface and the back surface of the ring-shaped sintered body were measured by means of a Rockwell B scale, thereby to determine the hardness (HRB).

TABLE 3

| | Formed body density ($g/cm^3$) | Sintered body density ($g/cm^3$) | Dimensional change ratio (%) | Radial crushing strength (MPa) | Hardness (HRB) |
|---|---|---|---|---|---|
| No. 1 of Example 2 | 7.10 | 7.06 | 0.38 | 910 | 82 |

TABLE 3-continued

| | Formed body density ($g/cm^3$) | Sintered body density ($g/cm^3$) | Dimensional change ratio (%) | Radial crushing strength (MPa) | Hardness (HRB) |
|---|---|---|---|---|---|
| No. 8 of Example 2 | 7.13 | 7.10 | 0.30 | 970 | 84 |
| Related art | 7.10 | 7.07 | 0.36 | 920 | 83 |

Table 3 indicates as follows: for Experiment No. 8 of Example 2 satisfying the requirements of the present invention, the mean particle size of graphite was large, and, as compared with Experiment No. 1 subjected to convection mixing, the formed body density was higher, and the dimensional change upon sintering was smaller (expansion was small). Accordingly, the sintered body density increased, and the radial crushing strength and the hardness of the sintered body also increased. Further, it is indicated as follows: even as compared with the related art technology, for Experiment No. 8 of Example 2, the formed body density was larger, and the dimensional change ratio was smaller, thus, the sintered body density increased, and the radial crushing strength was also very excellent. Incidentally, also for the related art technology, the graphite scattering ratio was measured. The result was 1%.

EXPLANATION OF REFERENCE NUMERALS

1 . . . Nuclepore filter
2 . . . Glass tube

The invention claimed is:

1. A method for manufacturing a mixed powder for powder metallurgy, comprising:

crushing graphite to a fine graphite with a mean particle size of 2.4 μm or less, and mixing the fine graphite with an iron based powder while applying a shear force, wherein the fine graphite is mixed with an iron based powder, without adding a binder, the fine graphite is mixed with the iron based powder while applying the shear force using a mixer equipped with stirring vanes moving in such a manner as to cut the mixed powder of the fine graphite and the iron based powder, and the mixed powder has a graphite scattering ratio of 20% or less.

2. The method according to claim 1, wherein the mixed powder has a graphite scattering ratio of 15% or less.

3. The method according to claim 1, wherein the mixed powder for powder metallurgy further comprises at least one selected from the group consisting of carbon black, fullerene, and a graphite with a mean particle size of 5 μm or more, mixed with the iron based powder.

4. The method according to claim 3, wherein the ratio of the fine graphite to the total amount of the fine graphite, the graphite having a mean particle size of 5 μm or more, the carbon black, and the fullerene is 15% or more.

5. The method according to claim 4, wherein the total amount of the fine graphite, the graphite having a mean particle size of 5 μm or more, the carbon black, and the fullerene is from 0.1 to 3 parts by mass per 100 parts by mass of the iron based powder.

6. The method according to claim 1, wherein the mixed powder for powder metallurgy further comprises at least one component selected from the group consisting of a lubricant, a strength improver, an abrasion resistance improver, and a machinability improver.

7. The method according to claim 1, wherein the mixed powder has a flowability of from 24.0 to 29.0 sec/50 g.

8. The method according to claim 1, wherein the mixed powder has an apparent density of 3.08 to 3.25 g/cm$^3$.

9. The method according to claim 1, wherein the mixed powder has a flowability of from 24.0 to 29.0 sec/50 g and an apparent density of 3.08 to 3.25 g/cm$^3$.

10. The method according to claim 1, wherein the mixed powder has a graphite scattering ratio of 10% or less.

11. The method according to claim 1, wherein the fine graphite with a mean particle size of 2.4 μm or less is prepared by crushing natural graphite.

12. A method for manufacturing a mixed powder for powder metallurgy, comprising:

crushing graphite to a fine graphite with a mean particle size of 2.4 μm or less, and mixing the fine graphite with an iron based powder while applying a shear force, wherein the fine graphite is mixed with an iron based powder to form a mixed powder, without adding a binder;

the fine graphite is mixed with the iron based powder while applying the shear force using a mixer equipped with stirring vanes moving in such a manner as to cut the mixed powder of the fine graphite and the iron based powder, and the mixed powder has a graphite scattering ratio of 17% or less and a flowability of from 24.0 to 28.9 sec/50 g.

13. The method according to claim 12, wherein the fine graphite has been subjected to wet crushing.

14. The method according to claim 13, wherein the mixed powder for powder metallurgy further comprises at least one selected from the group consisting of carbon black, fullerene, and a graphite with a mean particle size of 5 μm or more, mixed with the iron based powder.

15. The method according to claim 13, wherein the ratio of the fine graphite to the total amount of the fine graphite, the graphite having a mean particle size of 5 μm or more, the carbon black, and the fullerene is 15% or more.

16. The method according to claim 14, wherein the total amount of the fine graphite, the graphite having a mean particle size of 5 μm or more, the carbon black, and the fullerene is from 0.1 to 3 parts by mass per 100 parts by mass of the iron based powder.

17. The method according to claim 12, wherein the mixed powder for powder metallurgy further comprises at least one component selected from the group consisting of a lubricant, a strength improver, an abrasion resistance improver, and a machinability improver.

18. The method according to claim 12, wherein the mixed powder has a graphite scattering ratio of 10% or less.

19. The method according to claim 12, wherein the mixed powder has a graphite scattering ratio of 15% or less.

* * * * *